US011008926B1

(12) United States Patent
Osthelder et al.

(10) Patent No.: US 11,008,926 B1
(45) Date of Patent: May 18, 2021

(54) SYSTEM AND METHOD FOR CONTROLLING EXHAUST FLOW FROM AN INTERNAL COMBUSTION ENGINE

(71) Applicant: Brunswick Corporation, Mettawa, IL (US)

(72) Inventors: Robert R. Osthelder, Omro, WI (US); Travis C. Malouf, Oconomowoc, WI (US); Jeffrey C. Etapa, Oakfield, WI (US); Andrew S. Waisanen, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 175 days.

(21) Appl. No.: 16/146,520

(22) Filed: Sep. 28, 2018

(51) Int. Cl.
*F01N 13/12* (2010.01)
*F01N 13/00* (2010.01)
(Continued)

(52) U.S. Cl.
CPC ..... *F01N 13/001* (2013.01); *B63H 21/34* (2013.01); *F01N 13/12* (2013.01); *B63H 20/26* (2013.01); *F01N 2590/02* (2013.01)

(58) Field of Classification Search
CPC ..... B63H 20/245; B63H 21/32; B63H 20/02; F01N 13/082; F01N 2590/021; F02M 35/167
See application file for complete search history.

(56) References Cited

U.S. PATENT DOCUMENTS 2,082,059 A 6/1937 Irgens
3,045,423 A 7/1962 Hulsebus
(Continued)

FOREIGN PATENT DOCUMENTS

EP 2952994 12/2015
WO WO 2014033457 3/2014

OTHER PUBLICATIONS

Anderson et al., "Marine Drives Having a Muffler for Tertiary Exhaust Outlet," Unpublished U.S. Appl. No. 15/936,671, filed Mar. 27, 2018.

(Continued)

*Primary Examiner* — Phutthiwat Wongwian
*Assistant Examiner* — Diem T Tran
(74) *Attorney, Agent, or Firm* — Andrus Intellectual Property Law, LLP

(57) ABSTRACT

A system for controlling exhaust flow from an internal combustion engine powering a marine propulsion device includes a primary exhaust conduit having an upstream end receiving exhaust gas from the internal combustion engine and a downstream end discharging exhaust gas to a body of water via a gearcase housing. A bypass exhaust conduit has an upstream end receiving exhaust gas from the primary exhaust conduit and a downstream end discharging exhaust gas from a bypass outlet of the marine propulsion device. A bypass valve is selectively openable to allow exhaust gas to flow through the bypass conduit. A control module is in signal communication with the bypass valve. The control module opens the bypass valve to divert the exhaust gas through the bypass conduit and out the bypass outlet in response to selection of a control mode of the marine propulsion device other than a default lever control mode.

10 Claims, 6 Drawing Sheets

(51) Int. Cl.
*B63H 21/34* (2006.01)
*B63H 20/26* (2006.01)

(56) References Cited

U.S. PATENT DOCUMENTS

| | | | | |
|---|---|---|---|---|
| 3,434,447 | A | 3/1969 | Christensen et al. | |
| 3,745,964 | A | 7/1973 | Henrich | |
| 3,871,324 | A | 3/1975 | Snyder | |
| 4,036,162 | A | 7/1977 | Maier et al. | |
| 4,601,666 | A * | 7/1986 | Wood, Jr. | F01N 13/087 440/89 G |
| 4,773,215 | A * | 9/1988 | Winberg | F01N 13/087 440/89 G |
| 4,897,061 | A | 1/1990 | Koepsel et al. | |
| 5,299,961 | A | 5/1994 | Okamoto | |
| 5,348,500 | A | 9/1994 | Lassanske | |
| 5,674,099 | A | 10/1997 | Muramatsu et al. | |
| 5,759,073 | A | 6/1998 | Sumino et al. | |
| 5,807,151 | A | 9/1998 | Sumino | |
| 5,954,554 | A | 9/1999 | Bates | |
| 6,010,380 | A | 1/2000 | Wollard | |
| 6,299,496 | B1 * | 10/2001 | Griffiths | B63H 21/32 440/1 |
| 6,887,117 | B2 | 5/2005 | Varney et al. | |
| 7,195,528 | B2 | 3/2007 | Takada et al. | |
| 7,267,068 | B2 | 9/2007 | Bradley et al. | |
| 7,305,928 | B2 | 12/2007 | Bradley et al. | |
| 7,387,556 | B1 | 6/2008 | Davis | |
| 7,561,886 | B1 | 7/2009 | Gonring et al. | |
| 7,762,772 | B1 | 7/2010 | Alby et al. | |
| 8,050,630 | B1 | 11/2011 | Arbuckle | |
| 8,417,399 | B2 | 4/2013 | Arbuckle et al. | |
| 8,694,248 | B1 | 4/2014 | Arbuckle et al. | |
| 8,777,681 | B1 | 7/2014 | McNalley et al. | |
| 8,807,059 | B1 | 8/2014 | Samples et al. | |
| 8,924,054 | B1 | 12/2014 | Arbuckle et al. | |
| 8,998,663 | B1 | 4/2015 | Bonde et al. | |
| 9,039,468 | B1 | 9/2015 | Arbuckle et al. | |
| 9,126,666 | B2 | 9/2015 | Davis et al. | |
| 9,132,903 | B1 | 9/2015 | Gable et al. | |
| 9,227,711 | B2 | 1/2016 | Davis et al. | |
| 9,248,898 | B1 | 2/2016 | Kirchhoff et al. | |
| 9,308,980 | B1 | 4/2016 | Bonde et al. | |
| 9,376,194 | B1 | 6/2016 | Jensen et al. | |
| 9,376,195 | B1 | 6/2016 | Jaszewski et al. | |
| 9,377,780 | B1 | 6/2016 | Arbuckle et al. | |
| 9,733,645 | B1 | 8/2017 | Andrasko et al. | |
| 9,927,520 | B1 | 3/2018 | Ward et al. | |
| 9,944,376 | B1 | 4/2018 | Waisanen et al. | |
| 10,000,268 | B1 | 6/2018 | Poirier et al. | |
| 2015/0367924 | A1 | 12/2015 | Davis et al. | |

OTHER PUBLICATIONS

Waisanen, Andrew, "Exhaust Sound Enhancement Assembly and Method for a Marine Propulsion Device," Unpublished U.S. Appl. No. 15/812,265, filed Nov. 14, 2017.

* cited by examiner

SYSTEM AND METHOD FOR CONTROLLING EXHAUST FLOW FROM AN INTERNAL COMBUSTION ENGINE

FIELD

The present disclosure relates to exhaust systems for internal combustion engines of marine propulsion devices and to methods for controlling flow of exhaust gas through such systems.

BACKGROUND

U.S. Pat. No. 3,871,324 discloses an engine-driven outboard propulsion unit having a reversible propeller to selectively drive the propulsion unit in forward and reverse directions and passage means for conducting the exhaust gases from the engine through said unit, a pair of underwater discharge openings for said propulsion unit and respectively disposed fore and aft of the propeller to provide for selective exhaust discharge into the outflow of the propeller slipstream regardless of the direction of propulsion unit operation and thereby assure a solid flow of water to the propeller in both forward and reverse directions of operation of the propulsion unit.

U.S. Pat. No. 8,998,663 discloses an outboard motor and a method of making an outboard motor including providing an exhaust conduit having a first end that receives exhaust gas from an internal combustion engine and a second end that discharges exhaust gas to seawater via a propeller shaft housing outlet. An exhaust conduit opening is formed in the exhaust conduit between the first and second ends. The exhaust conduit opening is for discharging exhaust gas from the exhaust conduit to atmosphere via a driveshaft housing of the outboard motor and via an idle exhaust relief outlet and a driveshaft housing outlet in the driveshaft housing. The driveshaft housing outlet is vertically located between the propeller shaft housing outlet and the idle exhaust relief outlet. A cooling pump pumps cooling water from a cooling water inlet for cooling the internal combustion engine to a cooling water outlet for discharging cooling water from the outboard motor. The exhaust conduit opening and cooling water outlet are configured such that the cooling water collects by gravity in the driveshaft housing to a level that is above the exhaust conduit opening.

U.S. Pat. No. 9,944,376 discloses exhaust systems for outboard marine engines that are configured to propel a marine vessel in a body of water. An intermediate exhaust conduit is configured to receive the exhaust gas from the primary exhaust conduit. A primary muffler receives the exhaust gas from an intermediate exhaust conduit. A secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

U.S. Pat. No. 10,724,410 discloses a marine propulsion device including an internal combustion engine powering the marine propulsion device and an engine compartment containing the engine. A primary exhaust passageway routes exhaust gas away from the engine and out of the engine compartment. A sound enhancement assembly communicates with the primary exhaust passageway. The sound enhancement assembly includes a sound enhancement device tuned to amplify exhaust sounds of a predetermined frequency and a sound duct downstream of the sound enhancement device that transmits the amplified exhaust sounds to an area outside the engine compartment. The sound enhancement device isolates the sound duct from the exhaust gas. A method for modifying sounds produced by an exhaust system of the internal combustion engine is also disclosed.

Unpublished U.S. patent application Ser. No. 15/936,671, filed Mar. 27, 2018, discloses a marine drive having a primary exhaust outlet on its lower gearcase that discharges a primary flow of exhaust gas from the engine to seawater in which the marine drive is situated. A secondary exhaust outlet is located on the marine drive above the primary exhaust outlet and discharges a secondary flow of exhaust gas from the engine to atmosphere around the marine drive at least when the engine is operated at an idle speed. A tertiary exhaust outlet is located on the marine drive between the primary and secondary exhaust outlets, and discharges a tertiary flow of exhaust gas from the engine to the seawater or to the atmosphere depending upon a current location of the tertiary exhaust outlet with respect to the seawater. A muffler is configured to reduce noise emanating from the tertiary exhaust outlet.

Patents describing various joysticking, autopilot, station-keeping, and waypoint tracking features and related system and methods include: U.S. Pat. Nos. 7,267,068; 7,305,928; 7,561,886; 8,050,630; 8,417,399; 8,694,248; 8,777,681; 8,807,059; 8,924,054; 9,039,468; 9,132,903; 9,248,898; 9,377,780; 9,733,645; and 9,927,520.

Each of the above patents and applications is hereby incorporated by reference herein.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A system for controlling exhaust flow from an internal combustion engine powering a marine propulsion device configured to propel a marine vessel in a body of water is described according to one example of the present disclosure. The system comprises a primary exhaust conduit having an upstream end configured to receive exhaust gas from the internal combustion engine and a downstream end configured to discharge the exhaust gas to the body of water via a gearcase housing of the marine propulsion device, wherein the exhaust gas is discharged from an aft end of the gearcase housing. A bypass exhaust conduit has an upstream end configured to receive the exhaust gas from the primary exhaust conduit and a downstream end configured to discharge the exhaust gas from a bypass outlet of the marine propulsion device. A bypass valve is selectively openable to allow the exhaust gas to flow through the bypass conduit. A control module is in signal communication with the bypass valve. The control module opens the bypass valve to divert the exhaust gas through the bypass conduit and out the bypass outlet in response to selection of a control mode of the marine propulsion device other than a default lever control mode.

According to another example of the present disclosure, a method is disclosed for controlling flow of exhaust gas from an internal combustion engine powering a marine propulsion device configured to propel a marine vessel in a body of water. The method is carried out by a control module and comprises determining if the marine propulsion device is being operated in a control mode other than a default lever control mode, and determining if a transmission of the marine propulsion device is in reverse gear. In response to the marine propulsion device being operated in the control mode other than the default lever control mode and the transmission being in reverse gear, the method includes opening a bypass valve to direct a bypass flow of the exhaust gas through a bypass exhaust passageway for discharge from a bypass outlet of the marine propulsion device. The bypass exhaust passageway is configured to receive the bypass flow of the exhaust gas from a primary exhaust passageway when the bypass valve is open, and the primary exhaust passageway is configured to receive a primary flow of the exhaust gas from the internal combustion engine and to discharge the primary flow of the exhaust gas to the body of water via a gearcase housing of the marine propulsion device. The primary flow of the exhaust gas is discharged from an aft end of the gearcase housing, and the bypass outlet is located remote from the aft end of the gearcase housing.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

Figure 1:
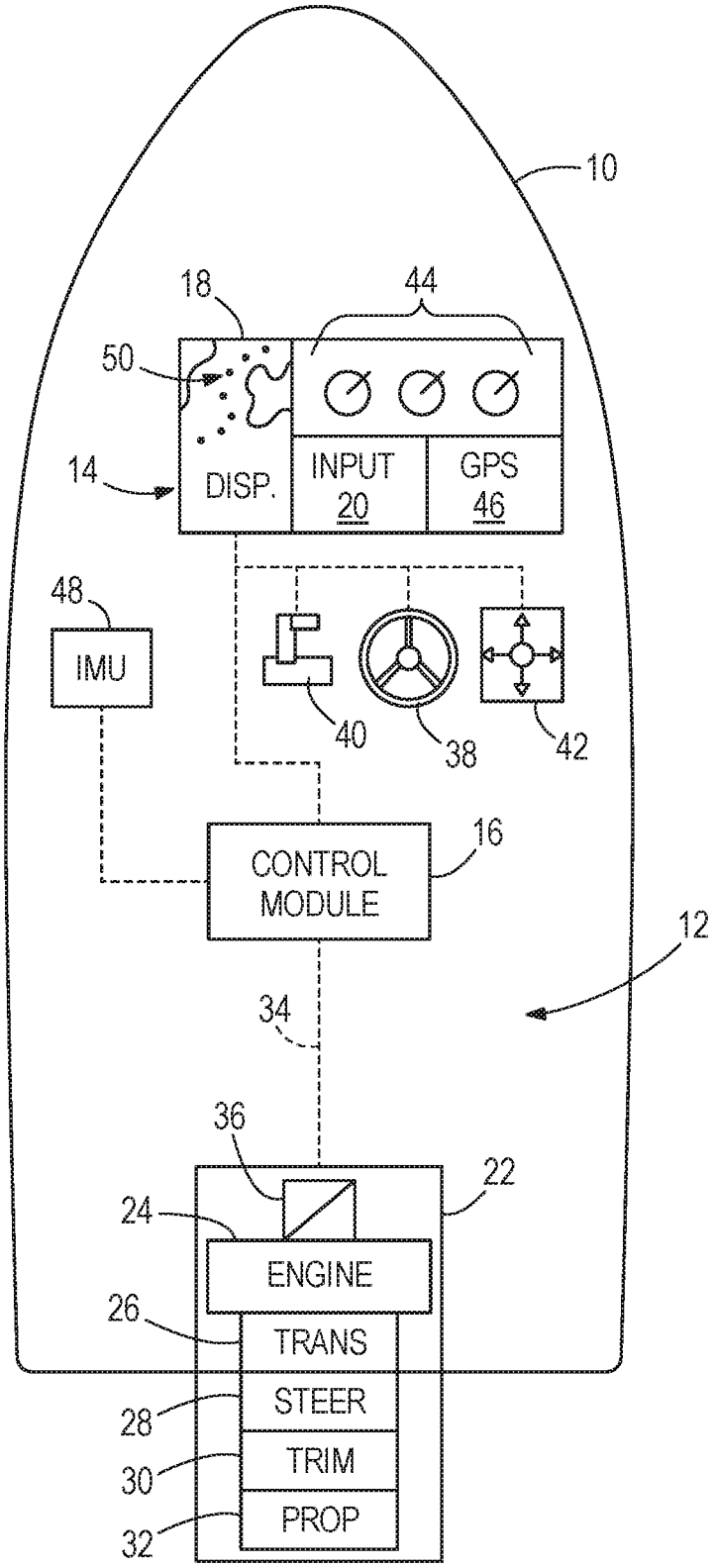
FIG. 1 illustrates one example of a marine vessel having a marine propulsion system including a marine propulsion device.

FIG. 1 illustrates an example of a marine vessel 10 and its marine propulsion system 12, including an electronic navigation device 14 and a control module 16 in signal communication with the electronic navigation device 14. The electronic navigation device 14 comprises a display screen 18 and a user input device 20. The user input device 20 could be one or more of a touch-sensitive display screen (which can be the same as the display screen 18), a keyboard, a keypad, a mouse, a track ball, a button or buttons, a stylus, a smart device such as a smart phone or a tablet, a remote control, a voice recognition module, etc. The electronic navigation device 14 can, for instance, be a chart plotter or a combined fish finder and chart plotter. Other electronic navigational devices provided with GPS capabilities or other location determination capabilities may be used.

The control module 16 controls a marine propulsion device 22, including an internal combustion engine 24, transmission 26, steering actuator 28, trim actuator 30, and propeller 32. Two or more propulsion devices, which may each have the components listed hereinabove, may instead be provided. The propulsion device(s) may be outboards, stern drives, pod drives, jet drives, and/or thrusters. The control module 16 is in signal communication via a communication link 34 with the electronic navigation device 14, a steering wheel 38, a throttle lever 40, a joystick 42, and a number of gauges 44, located at or near a helm of the marine vessel 10. Both the throttle lever 40 and the joystick 42 are operator input devices configured to provide throttle position (i.e., thrust) commands to a throttle valve 36 of the internal combustion engine 24 and shift commands to the transmission 26 via the control module 16. A position determination device, such as a global positioning system (GPS) receiver 46, is also provided as part of or in signal communication with the electronic navigation device 14. Note that other types of position determination devices, such as a radio-based system or a DGPS system, could instead be provided. The marine vessel 10 also has a heading detector, such as an inertial measurement unit (IMU) 48, in signal communication with the control module 16. In other examples, a compass, gyro, or an attitude and heading reference system (AHRS) may be used for detecting the vessel's heading. A speed of the marine vessel 10 could be determined from a vessel speed sensor such as a pitot tube or a paddle wheel, or by using GPS position readings over time.

The control module 16 is programmable and includes a processing system and a storage system. The control module 16 can be located anywhere on the marine vessel 10 and/or located remote from the marine vessel 10 and can communicate with various components of the marine vessel 10 via peripheral interfaces and wired and/or wireless links, as will be explained further hereinbelow. Although FIG. 1 shows one control module 16, the marine vessel 10 can include two or more control modules. Portions of the method disclosed herein below can be carried out by a single control module or by several separate control modules. For example, the system can have a control module located at or near the helm of the marine vessel 10 and can also have control module(s) located at or near each propulsion device. The electronic navigation device 14 can be programmed to perform some of the calculations described herein below, or the control module 16 can be programmed to perform certain calculations. The electronic navigation device 14 can provide commands to the control module 16 on its own initiative, or in response to a command from the control module 16.

In some examples, the control module 16 may include a computing system that includes a processing system, storage system, software, and input/output (I/O) interface for communicating with peripheral devices. The systems may be implemented in hardware and/or software that carries out a programmed set of instructions. For example, the processing system loads and executes software from the storage system, such as software programmed with a vessel maneuvering method or a method for an exhaust system, which directs the processing system to operate as described hereinbelow in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer-executable instructions for carrying out various functions as described herein.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The control module 16 communicates with one or more components on the marine vessel 10 via its 110 interface and the communication link 34, which can be a wired or wireless link. In one example, the communication link 34 is a controller area network (CAN) bus, but other types of links could be used. Note that the connections shown herein by dotted lines are not the only connections that may exist between the various components on the marine vessel 10, but rather are used for purposes of illustration.

As is known, the marine propulsion system 12 can be operated in a joysticking mode, in which the joystick 42 is used to input commands related to the desired magnitude and direction of thrust of the marine propulsion device 22. For example, the handle of the joystick 42 can be moved in a forward, backward, right, or left direction in order to command the marine vessel 10 to move in a corresponding direction. Additionally, the handle of the joystick 42 can be moved in a diagonal direction, indicating that the marine vessel 10 is to move diagonally, rather than directly to the front, back, right, or left. The handle of the joystick 42 can also be rotated about its upright axis in order to command the marine vessel 10 to rotate (yaw). In order to place the marine propulsion system 12 in the joysticking mode, the operator may shift the throttle lever 40 into a neutral detent position before selecting a joysticking mode via the base of the joystick 42, from the display screen 18, or via the user input device 20. Alternatively, the user need not select a joysticking mode after placing the throttle lever 40 in neutral, but may simply move the handle of the joystick 42 away from its neutral detent position or rotate the handle of joystick 42 about its axis in order to initiate the joysticking mode. The joysticking mode may be initiated in ways other than those described herein. Joysticking modes are well-known to those having ordinary skill in the art and are described in many of the above-incorporated patents, including U.S. Pat. No. 7,267,068, and therefore will not be described further herein below.

The marine propulsion system 12 may also be operated in a docking mode, in which the control module 16 automatically reduces any throttle position commands from an operator input device, such as the throttle lever 40 or the joystick 42, by predetermined factor before sending the reduced throttle position commands to the throttle valve 36 on the internal combustion engine 24. For example, the docking mode may be selected via the display screen 18 or the user input device 20. It may be required that the throttle lever 40 is placed in a neutral detent position before the docking mode is selected, or other methods for initiating the docking mode may be provided. When the docking mode is enabled, the control module 16 may reduce any throttle commands from the throttle lever 40 by, for example, 50%, before sending the reduced throttle commands to the throttle valve 36. When the docking mode is enabled and the operator is using the joystick 42, the control module 16 may reduce any throttle commands from the joystick 42 by, for example, 70%, before sending the reduced throttle commands to the throttle valve 36. In essence, in the docking mode, the marine propulsion device 22 produces less thrust than it would were it to be in a default (normal) control mode. This allows the operator to have more control over the incremental thrust via the throttle lever 40 or joystick 42, given the same amount of movement thereof.

As is known, in a station-keeping mode, the marine vessel 10 can be maintained in a single global position (defined by latitude and longitude) and at a predetermined heading by way of an algorithm that controls the marine propulsion device 22 to counteract the effects of wind, waves, current, etc. that would tend to move the marine vessel 10 off this location and/or to a new heading. The station-keeping mode can be initiated by placing the throttle lever 40 into a neutral detent position and thereafter selecting a station-keeping mode option via the display screen 18 and/or user input device 20. In some embodiments, the station-keeping mode will not be initiated until after the marine vessel's speed drops below a predetermined threshold. In the station-keeping mode, the marine propulsion device 22 is controlled to maintain the marine vessel 10 at a virtual anchor point. The control module 16 acts as a joystick and calculates left/right, fore/aft, and yaw commands required to drive the vessel's position error and heading error to zero by controlling thrust and angular orientation of the marine propulsion device 22.

The control module 16 determines when and how much corrective action to take according to a three-dimensional (left/right, fore/aft, and yaw) proportional, integral, and derivative (PID) control algorithm performed by a feedback controller. The PID feedback controller computes a desired force in the forward/back and left/right directions with reference to the marine vessel 10, along with a desired yaw moment relative to the marine vessel 10, in order to null the error elements. The control module 16 then sends commands to steer the marine propulsion device 22, control the power provided to the propeller 32, and control the thrust vector direction of the marine propulsion device 22 (i.e., control the transmission 26 in forward or reverse) in order to deliver the requested forces and moments. Such automatic correction of the position and heading of the marine vessel 10 can be achieved according to the principles described in U.S. Pat. No. 7,305,928, which was incorporated by reference herein above.

The marine vessel 10 can also be controlled in a waypoint tracking mode. In the waypoint tracking mode, the marine vessel 10 is automatically guided to a waypoint (e.g., a global position defined in terms of latitude and longitude) or to several waypoints along a track. To initiate waypoint tracking mode, for example, the operator of the marine vessel 10 may first place the throttle lever 40 in a forward detent position, then select a point or a track 50 from a chart plotter (e.g., display screen 18), and then select waypoint tracking mode from the chart plotter or from a separate autopilot controller. The control module 16 then obtains a commanded course according to the information provided by the chart plotter or autopilot controller. The control module 16 automatically guides the marine vessel 10 to each waypoint along the desired track 50 (or to the single selected waypoint) by providing steering and thrust commands to the marine propulsion device 22. If the marine vessel 10 veers off this course, such as due to the effect of wind, waves, or the like, the control module 16 determines the corrective action needed to resume the commanded course so as to guide the marine vessel 10 back on track. The control module 16 provides steering and/or thrust commands to the marine propulsion device 22 to achieve such corrective action.

In the waypoint tracking mode, the control module 16 may use a course feedback signal (indicating an estimate of the course along which the marine vessel 10 is actually being propelled) to determine whether correction needs to be made to the actual course of the marine vessel 10 in order to maintain the commanded course along the desired track. The feedback controller of the control module 16 uses the course feedback signal to determine how and to what extent the marine propulsion device 22 must be steered (and/or provided with what thrust) in order to re-orient the marine vessel 10 to the commanded course, such as using a PID control algorithm as described hereinabove. Such measurement and automatic correction of the course of the marine vessel 10 can be achieved according to the principles described in U.S. Pat. No. 9,377,780, which was incorporated by reference above.

The marine propulsion system 12 may also be operated in an auto-docking mode, in which the marine vessel 10 is automatically guided to a position near a dock, seawall, or other object of interest. The auto-docking mode uses inputs from sensors, which can identify nearby objects, as well as inputs from the GPS receiver 46 and/or IMU 48, in order to automatically control the thrust of the marine propulsion device 22 and direct the marine vessel 10 to a docked position while avoiding any obstacles between the marine vessel 10 and the object of interest. Auto-docking modes are described in U.S. Application Publication No. 2017/0253314; U.S. Application Publication No. 2018/0057132; U.S. Pat. Nos. 10,324,468; 10,429,845; and Unpublished U.S. application Ser. No. 15/986,395, filed May 22, 2018, each of which are hereby incorporated by reference in their entireties. In order to enable the auto-docking mode, the operator may shift the throttle lever 40 into a neutral detent position and then select the auto-docking mode from the display screen 18 or user input device 20.

Figure 3:
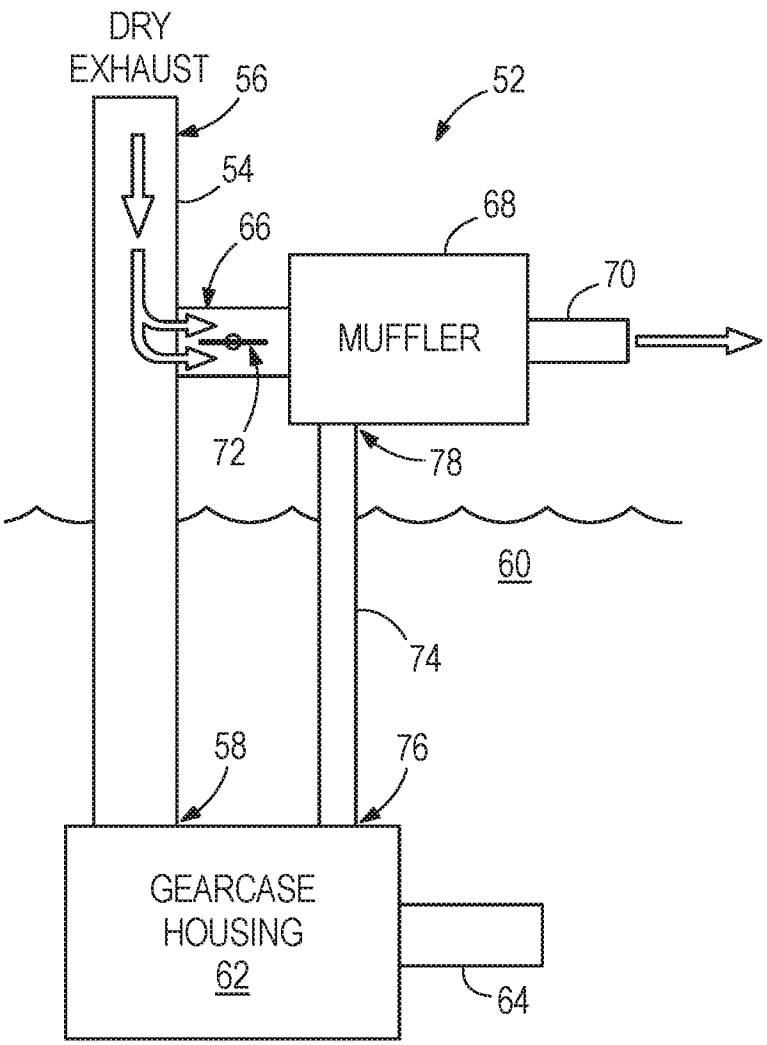
FIGS. 2 and 3 illustrate a schematic example of an exhaust system for the marine propulsion device of FIG. 1.
Figure 2:
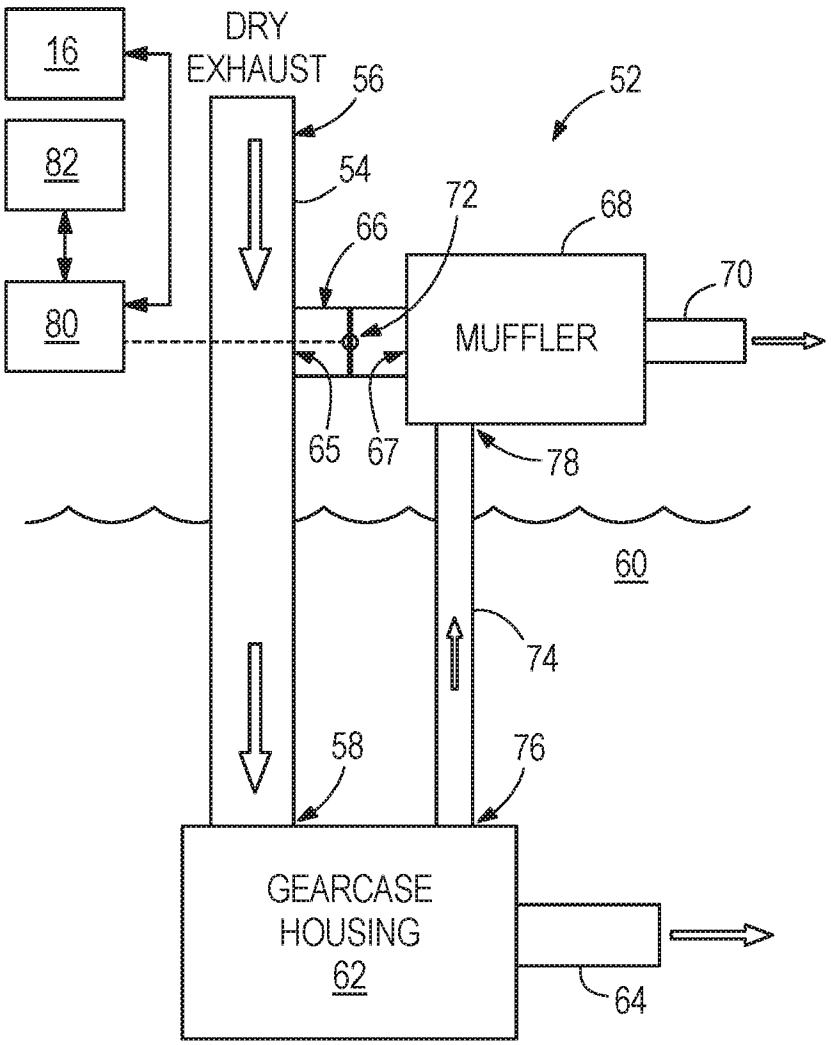

Referring now to FIGS. 2 and 3, an exemplary exhaust system 52 for use with the internal combustion engine 24 is schematically depicted. The exhaust system 52 includes a primary exhaust conduit 54 having an upstream end 56 that is configured to receive hot, dry exhaust gas from the internal combustion engine 24 and a downstream end 58 that is configured to discharge the exhaust gas to a body of water 60 via a gearcase housing 62 of the marine propulsion device 22. The manner in which the exhaust gas is discharged from the gearcase housing 62 can vary. In certain examples, the exhaust gas is discharged via a propeller housing outlet 64 that is located in the body of water 60 when the marine propulsion device 22 is in use. This is a conventional arrangement for discharging the exhaust gas from a marine propulsion device and thus the propeller housing outlet 64 is schematically shown and is not further described herein.

An bypass exhaust conduit 66 is coupled to the primary exhaust conduit 54 between the upstream end 56 and the downstream end 58 thereof. The bypass exhaust conduit 66 has an upstream end 65 that receives the exhaust gas from the primary exhaust conduit 54. Optionally, a muffler (sometimes referred to as an "idle relief muffler") 68 receives the exhaust gas from a downstream end 67 of the bypass exhaust conduit 66 and discharges the exhaust gas to an idle relief outlet 70, which typically is formed through a cowling of the marine propulsion device 22. In other examples, the bypass exhaust conduit 66 discharges the exhaust gas to the idle relief outlet 70 without passing through a muffler. The idle relief outlet 70 is configured to discharge the exhaust gas to atmosphere. More specifically, the idle relief outlet 70 is configured to be located above the body of water 60 in which the marine propulsion device 22 is operating, at least when the internal combustion engine 24 of the marine propulsion device 22 is operated at an idle speed.

According to the present disclosure, a bypass valve 72 is coupled to and/or located in the bypass exhaust conduit 66 between the primary exhaust conduit 54 and the idle relief outlet 70. The type of bypass valve 72 can vary and in certain examples can be a conventional mechanically-controlled valve and in other examples can be a conventional electrically-controlled valve. The bypass valve 72 is positionable into an open position, shown in FIG. 3, wherein the exhaust gas is permitted to flow through the bypass exhaust conduit 66 from the primary exhaust conduit 54 to the muffler 68 and idle relief outlet 70. Thus, in the open position, the exhaust gas is allowed to bypass the downstream end 58 of the primary exhaust conduit 54 and bypass the gearcase housing 62 and flow directly from the primary exhaust conduit 54 to the idle relief outlet 70 via the bypass exhaust conduit 66 and optionally via the muffler 68. The bypass valve 72 is alternately positionable into a closed position, shown in FIG. 2, wherein the exhaust gas is not permitted to flow through the bypass exhaust conduit 66 from the primary exhaust conduit 54, and thus is not allowed to bypass the downstream end 58 of the primary exhaust conduit 54 and gearcase housing 62. Instead, the exhaust gas is forced to flow to the gearcase housing 62 for subsequent discharge to the body of water 60 via the propeller housing outlet 64 and/or to atmosphere via the muffler 68 and idle relief outlet 70, which are connected to the gearcase housing 62 by a secondary exhaust conduit 74. The secondary exhaust conduit 74 has an upstream end 76 that is configured to receive the exhaust gas from the gearcase housing 62 and a downstream end 78 that is configured to discharge the exhaust gas to the muffler 68, for subsequent discharge via the idle relief outlet 70.

In some examples, the bypass valve 72 can be positionable into one or more intermediate position(s) wherein, as compared to the noted open position shown in FIG. 3, a reduced amount of the exhaust gas is permitted to bypass the downstream end 58 of the primary exhaust conduit 54 and gearcase housing 62. In other words, when the bypass valve 72 is in the intermediate position(s), some of the exhaust gas is allowed to bypass the downstream end 58 of the primary exhaust conduit 54 and bypass the gearcase housing 62 and flow directly from the primary exhaust conduit 54 to the idle relief outlet 70 via the bypass exhaust conduit 66 and optionally the muffler 68. The remainder of the exhaust gas is forced to flow to the gearcase housing 62 for subsequent discharge to the body of water 60 via the propeller housing outlet 64 and/or to atmosphere via the muffler 68 and idle relief outlet 70, which are connected to the gearcase housing 62 by the secondary exhaust conduit 74.

In some examples, the exhaust system 52 can include an operator input device 80 that is mechanically and/or electrically and/or otherwise communicatively coupled to and configured to control the bypass valve 72. The operator input device 80 can be configured such that, via the operator input device 80, an operator has the ability to selectively position the bypass valve 72 into and out of the open and closed positions, and optionally the intermediate position(s). The type and configuration of the operator input device 80 can vary, and the manner in which the operator input device 80 is connected to the bypass valve 72 can vary. In certain non-limiting examples, the operator input device 80 can include one or more mechanical levers, computer keypads, slider bars, touch screens, and/or the like. The operator input device 80 can be configured to directly communicate with and control the position of the bypass valve 72 via, for example, a mechanical or electronically wired or wireless communication link, an example of which is schematically shown in the drawings. In other examples, the operator input device 80 can be configured to communicate an operator input to the control module 16, which can be configured to electronically control the bypass valve 72.

Optionally, the exhaust system 52 can include an indicator device 82 that is configured to indicate to the operator a current position of the bypass valve 72. The operator input device 80 and/or indicator device 82 can be located, for example, at the helm of the marine vessel 10. The type of indicator device 82 can vary. In certain non-limiting examples, the indicator device 82 can be one of the gauges 44, or can include a video or touch screen (e.g., display screen 18), flashing lights, and/or the like. The indicator device 82 can be electronically controlled by the control module 16 to indicate to the operator the current position of the bypass valve 72.

Figure 4:
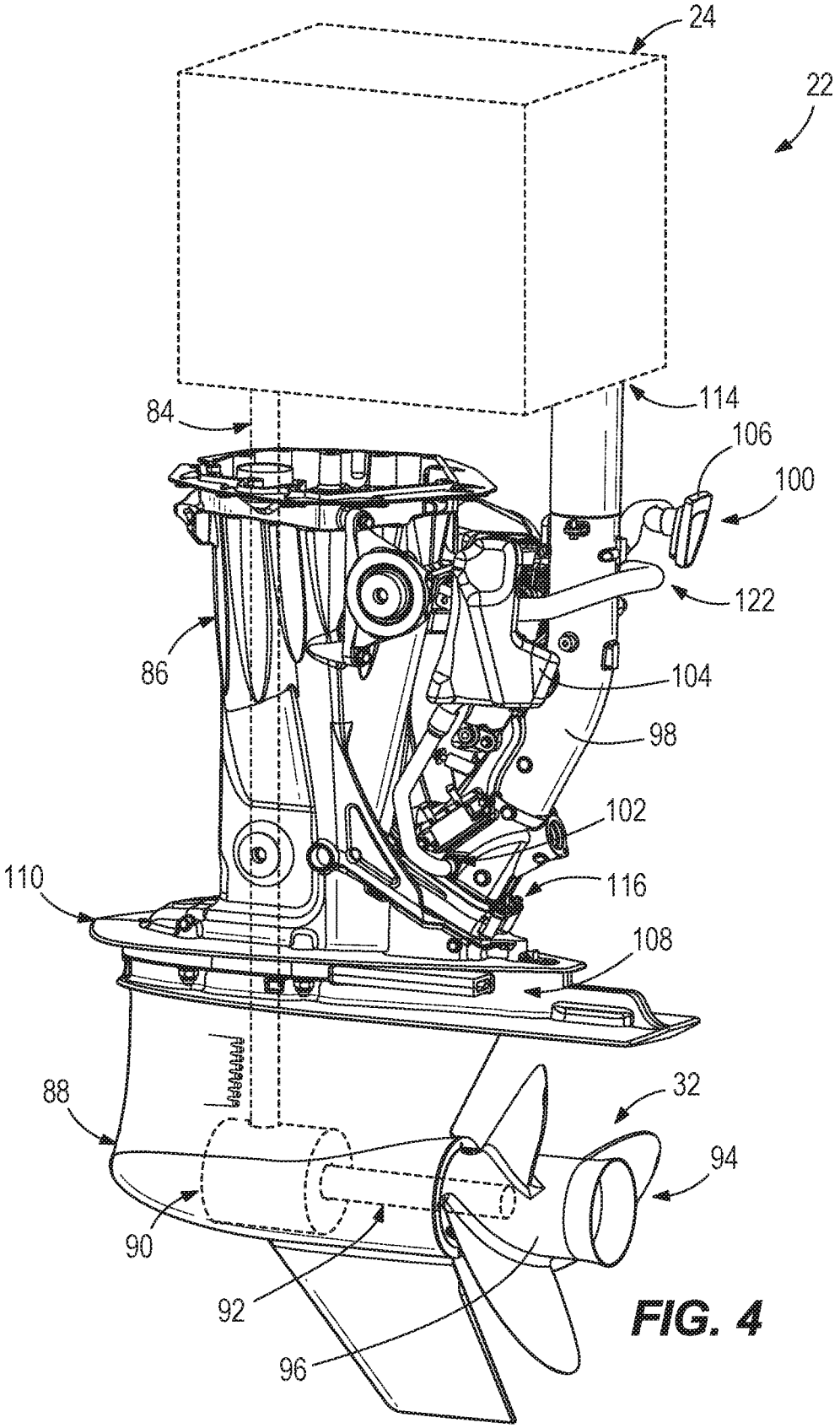
FIG. 4 illustrates one example of a marine propulsion device that could be used on the marine vessel of FIG. 1.
Figure 5:
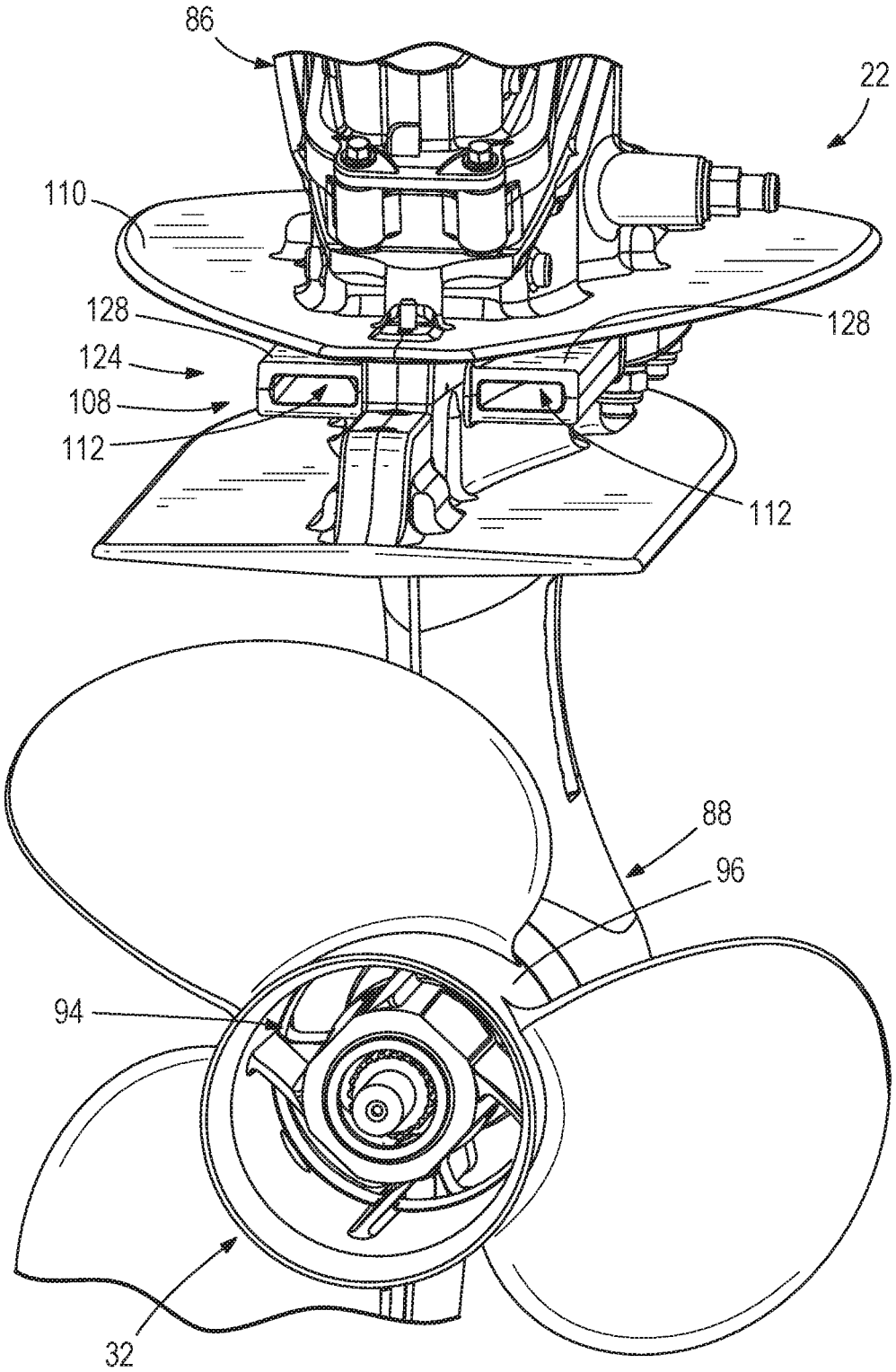
FIG. 5 illustrates a detailed view of a portion of the marine propulsion device of FIG. 4.
Figure 6:
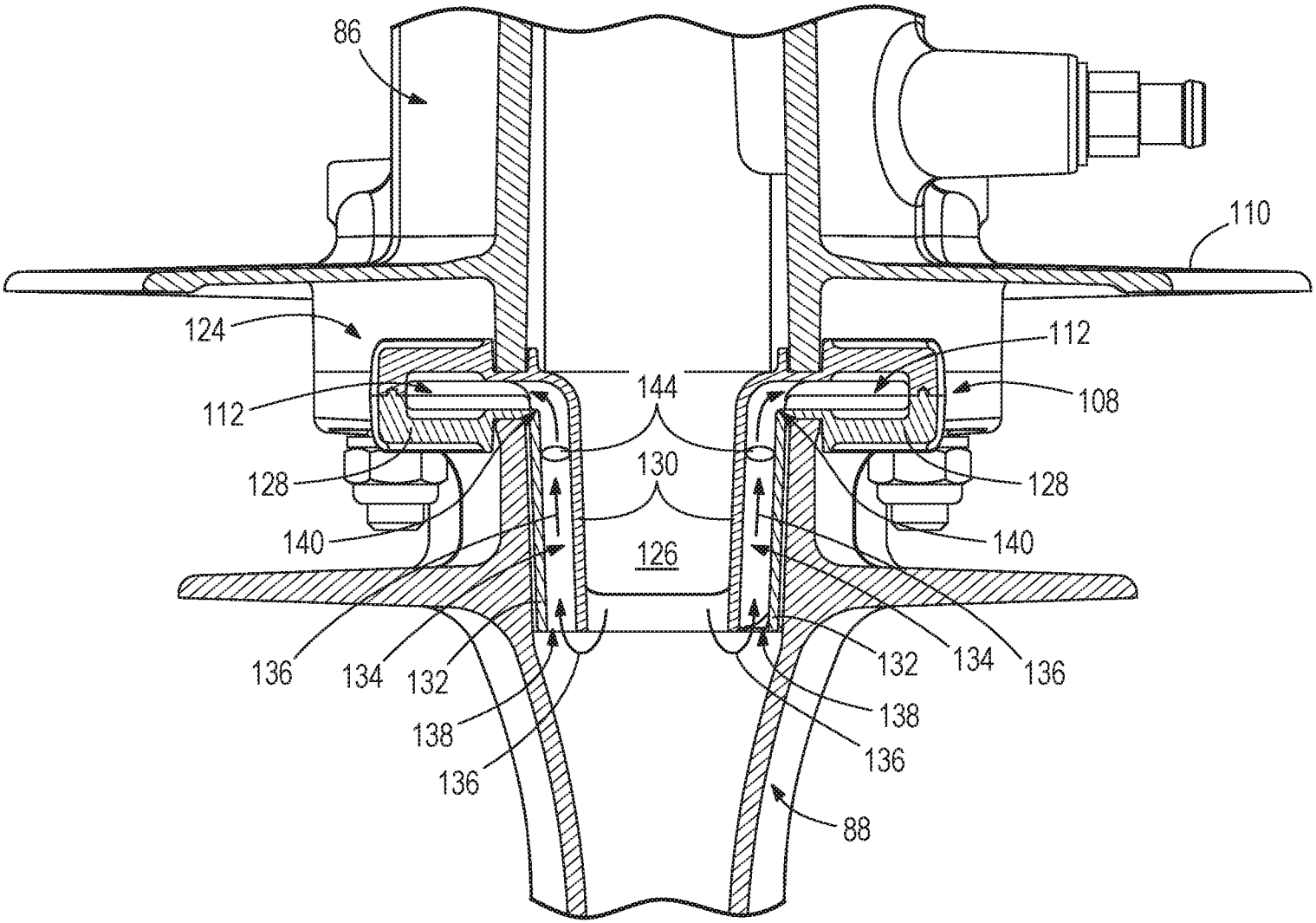
FIG. 6 illustrates a cross-sectional view of a portion of FIG. 5.

FIGS. 4-6 depict portions of one example of the marine propulsion device 22, including an example of a muffler for a tertiary flow of exhaust gas. As noted herein above, the marine propulsion device 22 is powered by the internal combustion engine 24 (shown schematically) that causes rotation of a generally vertically extending driveshaft 84. The driveshaft 84 extends from the internal combustion engine 24 into a driveshaft housing 86 located below the internal combustion engine 24. A lower gearcase housing 88 is located below the driveshaft housing 86 and contains a transmission gearset 90 (shown schematically) that operably connects the driveshaft 84 to a generally horizontally extending propeller shaft 92. The propeller shaft 92 laterally extends from the gearcase housing 88 and supports the propeller 32 such that rotation of the propeller shaft 92 causes rotation of the propeller 32. Thus, operation of the internal combustion engine 24 causes rotation of the driveshaft 84, which in turn causes rotation of the propeller shaft 92 and propeller 32, as is conventional. The transmission gearset 90 can be actuated by a conventional shift actuator (not shown) to control the rotational direction of the propeller shaft 92 and propeller 32 in either forward, neutral, or reverse gears, as is conventional.

As shown in FIG. 4, the marine propulsion device 22 has a primary exhaust outlet 94 from the gearcase housing 88 via a hub 96 of propeller 32. The primary exhaust outlet 94 discharges a primary flow of exhaust gas from the internal combustion engine 24 directly to the water in which the marine propulsion device 22 is situated. In the presently illustrated example, the primary exhaust outlet 94 receives the primary flow of exhaust gas from a primary exhaust conduit 98 that extends from an upstream end 114 coupled to the internal combustion engine 24 and vertically downwardly alongside the driveshaft housing 86. In other examples, the primary exhaust conduit 98 is located internally of the driveshaft housing 86. The primary flow of exhaust gas is communicated from a downstream end 116 of the primary exhaust conduit 98 to the gearcase housing 88 and then to the primary exhaust outlet 94 via the hub 96 of the propeller 32.

The marine propulsion device 22 also has an idle relief system 122 including a secondary exhaust outlet 100 located on the marine propulsion device 22 above the primary exhaust outlet 94, generally located near the top of the driveshaft housing 86. The secondary exhaust outlet 100 discharges a secondary flow of exhaust gas from the internal combustion engine 24 at least when the internal combustion engine 24 is operated at idle speeds. The secondary exhaust outlet 100 remains above water during all operational states of the marine propulsion device 22. The secondary exhaust outlet 100 receives the secondary flow of exhaust gas from an opening 102 in the primary exhaust conduit 98, wherein the secondary flow of exhaust gas flows to an idle relief muffler 104, and from the idle relief muffler 104 to the atmosphere via an idle relief grommet 106.

The marine propulsion device 22 also has a tertiary exhaust outlet 108 located on the marine propulsion device 22 vertically between the primary and secondary exhaust outlets 94, 100. In the illustrated example, the tertiary exhaust outlet 108 is located proximate to the union between the driveshaft housing 86 and gearcase housing 88 and adjacent to a cavitation plate 110 on the gearcase housing 88; however, the location can vary from what is shown. The tertiary exhaust outlet 108 discharges a tertiary flow of exhaust gas from the internal combustion engine 24 to the water or to the atmosphere depending on a current location of the tertiary exhaust outlet 108 with respect to the water, as the marine propulsion device 22 changes position in the water deepening on the tilt and trim thereof and the position of the marine vessel 10 with respect to the surface of the water, which may depend on vessel speed.

Referring to FIGS. 5 and 6, a muffler 124 for controlling exhaust noise associated with the tertiary exhaust outlet 108 is described. The muffler 124 is located between the driveshaft housing 86 and the gearcase housing 88, and is partially disposed in the gearcase housing 88, as shown in FIG. 6. The muffler 124 has an expansion chamber 126 that promotes expansion of the tertiary flow of exhaust gas therein and also provides a pathway for the primary flow of exhaust gas to flow therethrough. The muffler 124 further has port and starboard wings 128 that laterally extend from port and starboard sides of the expansion chamber 126 and are sandwiched between the driveshaft housing 86 and gearcase housing 88. Port and starboard aftwardly-oriented outlet channels 112 are formed in the port and starboard wings 128, respectively, and are configured to discharge the tertiary flow of exhaust gas from the expansion chamber 126.

The tertiary flow of exhaust gas follows a tortuous path from the expansion chamber 126 to the tertiary exhaust outlet 108. Specifically, the expansion chamber 126 has inner sidewalls 130 and outer sidewalls 132. Port and starboard passageways 134 vertically extend between the inner and outer sidewalls 130, 132 and are connected to the port and starboard outlet channels 112, respectively. Thus, the primary flow of exhaust gas is conveyed downwardly through and past the expansion chamber 126 and to the gearcase housing 88 for discharge via the primary exhaust outlet 94 through the propeller hub 96. The tertiary flow of exhaust gas is a portion the primary flow of exhaust gas that separates from the primary flow of exhaust gas and flows upwardly through the port and starboard passageways 134 (as shown by the arrows 136) and then aftwardly through the port and starboard outlet channels 112 for discharge from the marine propulsion device 22. Thus, the port and starboard passageways 134 act as bypass exhaust conduits having upstream ends 138 configured to receive exhaust gas from the primary exhaust conduit 98 (via expansion chamber 126) and downstream ends 140 configured to discharge the exhaust gas from bypass outlets (outlet channels 112) of the marine propulsion device 22. Each bypass exhaust conduit 134 is provided with a bypass valve 144 therein, which is communicatively connected to the control module 16, for purposes that will be described herein below.

During research and development, the present inventors realized that while operating in certain modes, specifically those modes in which the marine propulsion device 22 is likely to be required to produce a reverse thrust, it may be desirable to have less exhaust exiting from the gearcase housing 62, 88. Reducing the amount of exhaust gas that is pulled through the propeller 32 allows for increased reverse thrust authority while operating in these modes. Although some exhaust may still exit from the gearcase housing 62, 88, in general, by diverting at least a portion of the exhaust gas through a bypass outlet located other than near the propeller 32, the propeller 32 is able to get better bite in the water when operating in reverse. Additionally, the present inventors have realized that bypassing exhaust gas through a bypass conduit and outlet only when increased reverse thrust authority is required, or only when the transmission 26 is in reverse, reduces noise from the marine propulsion device 22 as opposed to if the bypass valve(s) were always open.

Therefore, the present disclosure is of a system for controlling exhaust flow from an internal combustion engine 24 powering a marine propulsion device 22 configured to propel a marine vessel 10 in a body of water 60. The system includes a primary exhaust conduit 54, 98 having an upstream end 56, 114 configured to receive exhaust gas from the internal combustion engine 24 and a downstream end 58, 116 configured to discharge the exhaust gas to the body of water 60 via the gearcase housing 62, 88 of the marine propulsion device 22. The exhaust gas is discharged from an aft end of the gearcase housing 62, 88, such as through the propeller housing outlet 64 or primary exhaust outlet 94.

The system also includes a bypass exhaust conduit 66, 134 having an upstream end 65, 138 configured to receive the exhaust gas from the primary exhaust conduit 54, 98 and a downstream end 67, 140 configured to discharge the exhaust gas from a bypass outlet of the marine propulsion device 22. For example, the bypass outlet can be the idle relief outlet 70 (FIGS. 2 and 3) or the outlet channels 112 (FIGS. 5 and 6). As noted hereinabove, a muffler 68 need not be provided in the embodiments of FIGS. 2 and 3, and the downstream end 67 of the bypass exhaust conduit 66 may be connected directly to the bypass outlet. In one example, the downstream end 67 of the bypass exhaust conduit 66 is the bypass outlet itself.

In order to provide for selective flow of the exhaust gas through the bypass exhaust conduit 66, 134, a bypass valve, which is selectively openable to allow the exhaust gas to flow through the bypass exhaust conduit 66, 134, may be provided. In the example of FIGS. 2 and 3, the bypass valve is shown schematically at 72. In the example of FIG. 6, two bypass valves 144 are schematically shown situated within the bypass exhaust conduits 134.

As noted, the bypass valve(s) 72, 144 is/are in signal communication with the control module 16. According to the method of the present disclosure, the control module 16 opens the bypass valve(s) 72, 144 to divert the exhaust gas through the bypass exhaust conduit 66, 134 and out the bypass outlet 70, 112 in response to selection of a control mode of the marine propulsion device 22 other than a default lever control mode. Note that in the example of FIGS. 4-6, a bypass conduit, bypass valve, and bypass outlet like that shown in FIGS. 2 and 3 could be provided with the idle relief system 122. Bypass valves could be provided solely in the bypass exhaust conduits 134, or in both the bypass exhaust conduits 134 and the bypass exhaust conduit associated with the idle relief system 122. The control module 16 could selectively open whichever bypass valve(s) was/were provided according to the algorithm described more fully herein below.

In the default lever control mode, as is known, the operator uses the throttle lever 40 and steering wheel 38 to provide shift/thrust and steering commands, respectively, to the marine propulsion device 22. For example, the operator can move the throttle lever 40 into the neutral detent position in order to stop providing thrust to the marine vessel 10; into a forward gear position in order to propel the marine vessel 10 in a forward direction while steering with the steering wheel 38; or into a reverse gear position in order to propel the marine vessel 10 in a backwards direction while steering with the steering wheel 38.

In one example, the control mode other than the default lever control mode is any control mode in which the operator does not control shift and throttle solely with the throttle lever 40. For example, the control mode may be one in which the control module 16 automatically commands the marine propulsion device 22 to produce thrust intended to cause the marine vessel 10 to achieve a predefined objective. The predefined objective may be to remain electronically anchored at a given latitude and longitude (station-keeping mode), to travel along a predefined track (waypoint tracking mode), or to automatically propel the marine vessel 10 to an object of interest and thereafter maintain the marine vessel 10 in proximity to that object (auto-docking mode). In such a control mode in which the marine vessel 10 is to achieve a predefined objective, the control module 16 may open the bypass valve 72, 144 in response to an additional determination that a reverse thrust commanded by the control module 16 is insufficient to cause the marine vessel 10 to achieve the predefined objective. In other words, if the control module 16 calculates that the marine propulsion device 22 needs to provide a reverse thrust of a certain value to achieve a desired position or heading, but feedback from the GPS receiver 46 or IMU 48 indicates that the marine vessel 10 is not able to achieve the desired position or heading with such reverse thrust, the control module 16 may determine that additional reverse thrust authority is required. The control module 16 will therefore open the bypass valve 72, 144 in order to divert some of the exhaust gas away from the primary exhaust pathway, and therefore away from being discharged from the rear of the gearcase housing 62, 88.

In another example, even before the control module 16 determines that the reverse thrust it calculates as being required in order to achieve the predefined objective is not enough to achieve such objective, the operator may select an operator-selectable input configured to enable high-sensitivity of the control mode. The operator-selectable input may be a button or selection available via the display screen 18 or the user input device 20. The control module 16 may open the bypass valve in response to an additional determination that high-sensitivity of the control mode is enabled. In other words, if the operator knows that the marine vessel 10 is operating in high wind or fast current conditions, the operator may choose to enable high-sensitivity of the high station-keeping, waypoint tracking, or auto-docking mode in order to automatically provide increased reverse thrust authority to the marine propulsion device 22, assuming such increased authority will be required to counteract the external conditions acting on the marine vessel 10.

In another example, the control mode other than the default lever control mode is one in which the control module 16 does not receive the shift or thrust commands from the throttle lever 40. For example, the control mode may be the joysticking mode, in which shift and thrust commands are mapped from a position of the joystick 42.

In another example, the control mode is one in which the control module 16 automatically reduces the throttle position commands from an operator input device configured to provide throttle position commands to the throttle valve 36 of the internal combustion engine 24 via the control module 16 by a predetermined factor before sending the reduced throttle position commands to the throttle valve 36. For example, the control mode could be the docking mode, in which the operator has requested that throttle commands from the throttle lever 40 or joystick 42 be reduced in order to provide more precision to the level of throttle control.

In any of the above examples, the control module 16 may open the bypass valve 72, 144 in response to an additional determination that the transmission 26 of the marine propulsion device 22 is in reverse gear. The control module 16 may make this determination based on a reading from a gear position sensor or based on the commanded gear position the control module 16 sent to the transmission 26. In such a manner, the control module 16 may control bypass flow of the exhaust gas such that the bypass flow occurs only when the marine propulsion device 22 is actually operating in reverse gear, and thus increased reverse thrust authority may be necessary.

In another example, the control module 16 opens the bypass valve 72, 144 in response to an additional determination that external environmental conditions are acting on the marine vessel 10 in a direction opposite that of a reverse thrust of the marine propulsion device 22. For example, the control module 16 may be provided in signal communication with a wind sensor or current sensor, which may provide the control module 16 with information regarding whether external conditions are calm or rough. If external conditions are relatively rough and are acting in a direction opposite that of the reverse thrust commanded from the marine propulsion device 22, the control module 16 may open the bypass valve 72, 144 in order to provide increased reverse thrust authority. Whether a certain wind speed or current speed would be considered enough that increased reverse thrust authority was required could be calibrated into the vessel's personality and based on vessel size and/or weight. Note that the direction of the external disturbance on the marine vessel 10 need not be one that acts in an aft-to-fore direction of the marine vessel 10, but could be an external force that acts opposite the direction of reverse thrust of the marine propulsion device 22 taking a steering angle thereof into account.

In all of the above examples, the bypass valve 72, 144 may be configured to be incrementally opened and closed, or to be fully opened or fully closed. For example, in response to the above-noted conditions being met, the control module 16 may fully open the bypass valve 72, 144, and in response to the above-noted conditions not being met, the control module 16 may fully close the bypass valve 72, 144. In other examples, in response to determining that the above-noted conditions are met, the control module 16 may incrementally open the bypass valve 72, 144 at a fixed ramp-in rate, which may be calibrated. In response to determining that the above-noted conditions are not met, the control module 16 may fully close the bypass valve 72, 144 or may incrementally close the bypass valve 72, 144 at a fixed ramp-out rate, which may be calibrated. In still other examples, incremental opening and closing of the bypass valve can be used in order to provide different levels of reverse thrust authority. For example, the bypass valve 72, 144 can be opened to a position that is less than fully open if it is determined that a small amount of increased reverse thrust authority is required. If feedback indicates that more reverse thrust authority is in fact required, the bypass valve 72, 144 can be opened even more. In another example, a button, slider bar, or similar user input device (see operator input device 80, FIG. 2) could be provided at the helm, such as on the display screen 18 or at the user input device 20, that allows the operator to feather in the increased reverse thrust authority. For example, if the operator knows that environmental conditions are somewhat transient, the operator may choose to open the bypass valve 72, 144 to a less than fully open position. On the other hand, if the operator knows that the marine vessel 10 is operating in very rough waters, the operator may choose to open the bypass valve 72, 144 to a more open or fully open position.

While some of the examples shown and described hereinabove show the bypass conduit and the bypass outlet being in fluid condition with the idle relief system of the marine propulsion device 22, note that this is not necessary, as in the example of bypass valves 144 provided in bypass exhaust conduits 134 (FIG. 6). Furthermore, a completely separate bypass conduit and outlet could be provided on the marine propulsion device 22. Note that the bypass conduit and bypass outlet could be provided at locations other than those shown herein. The bypass outlet can be located above or below the water level when the marine propulsion device 22 is operating at idle. In general, the bypass outlet will be located remote from the aft end of the gearcase housing 62, 88 so that exhaust gas emitted therefrom not affect the bite of the propeller 32. In one example, when the marine propulsion device 22 is a stern drive, the bypass conduit could divert exhaust gas through the back of the transom of the marine vessel 10, rather than diverting it from the gearcase housing.

Figure 7:
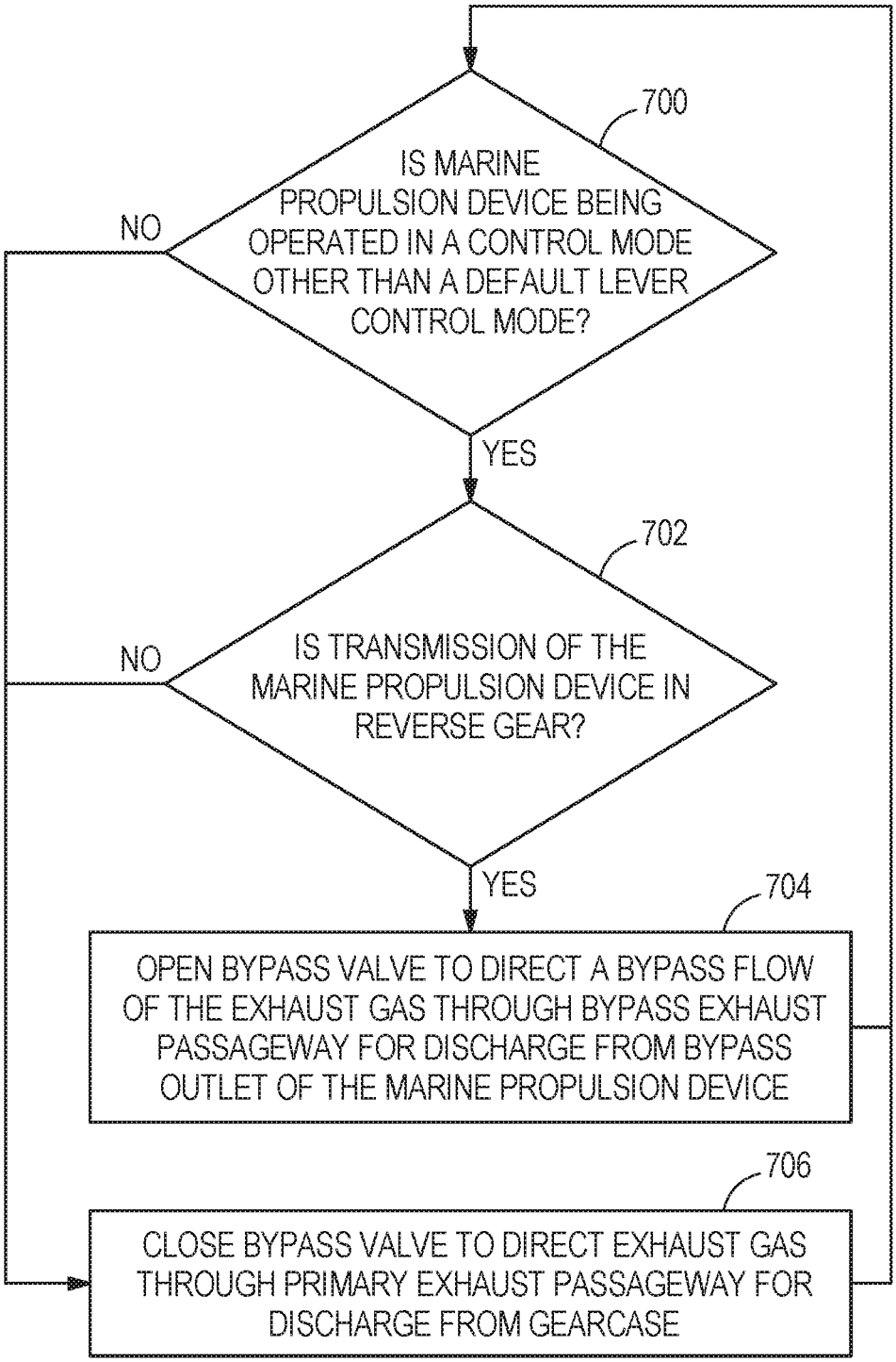
FIG. 7 illustrates one example of a method for controlling flow of exhaust gas from an internal combustion engine powering a marine propulsion device according to the present disclosure.

Now turning to FIG. 7, a method for controlling flow of exhaust gas from an internal combustion engine 24 powering marine propulsion device 22 configured to propel a marine vessel 10 in a body of water 60 will be described. The method is carried out by control module 16 and includes, as shown at 700, determining if marine propulsion device 22 is being operated in a control mode other than a default lever control mode. If yes, the control module 16 next determines if a transmission 26 of the marine propulsion device 22 is in reverse gear, as shown at 702. If yes, in response to the marine propulsion device 22 being operated in the control mode other than the default lever control mode and the transmission 26 being in reverse gear, the control module opens the bypass valve 72, 144 to direct a bypass flow of the exhaust gas through a bypass exhaust passageway 66, 134 for discharge from a bypass outlet 70, 112 of the marine propulsion device 22, as shown at 704. As noted herein above, the bypass exhaust passageway 66, 134 is configured to receive the bypass flow of the exhaust gas from the primary exhaust passageway 54, 98 when the bypass valve 72, 144 is open. The primary exhaust passageway 54, 98 is configured to receive a primary flow of the exhaust gas from the internal combustion engine 24 and to discharge the primary flow of the exhaust gas to the body of water 60 via a gearcase housing 62, 88 of the marine propulsion device 22. The primary flow of the exhaust gas is discharged from an aft end of the gearcase housing 62, 88, and the bypass outlet 70, 112 is located remote from the aft end of the gearcase housing 62, 88.

If no at either of the determinations made at 700 or 702, the control module 16 closes the bypass valve 72, 144 (or maintains the bypass valve 72, 144 in a closed position) to direct exhaust gas through the primary exhaust passageway 54, 98 for discharge from the gearcase housing 62, 88. See 706.

By implementing the above method on a marine propulsion device 22 provided with a bypass exhaust conduit/passageway, the marine propulsion device 22 is able to provide increased reverse thrust authority when necessary. As noted hereinabove, such reverse thrust authority may be increased when the marine propulsion device 22 is operated in a control mode other than a default lever control mode, such as in a station-keeping, waypoint tracking, joysticking, auto-docking, or docking mode. The increased reverse thrust authority may additionally or alternatively be provided when the control module 16 determines that reverse thrust actually being produced is insufficient to cause the marine vessel 10 to achieve a predefined position and/or heading or when high-sensitivity of the control mode is enabled by the operator. In other examples, the control module 16 may open the bypass valve in response to a determination that the operator or control module 16 is demanding an engine speed or a vessel speed above a predetermined threshold speed in a reverse direction. Such an embodiment might be provided even when the marine propulsion device 22 is operating in the default lever control mode.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A system for controlling exhaust flow from an internal combustion engine powering a marine propulsion device configured to propel a marine vessel in a body of water, the system comprising:

a primary exhaust conduit having an upstream end configured to receive exhaust gas from the internal combustion engine and a downstream end configured to discharge the exhaust gas to the body of water via a gearcase housing of the marine propulsion device, wherein the exhaust gas is discharged from an aft end of the gearcase housing;

a bypass exhaust conduit having an upstream end configured to receive the exhaust gas from the primary exhaust conduit and a downstream end configured to discharge the exhaust gas from a bypass outlet of the marine propulsion device;

a bypass valve selectively openable to allow the exhaust gas to flow through the bypass exhaust conduit;

a control module in signal communication with the bypass valve; and an operator input device configured to provide throttle position commands to a throttle valve of the internal combustion engine via the control module;

wherein the control module opens the bypass valve to divert the exhaust gas through the bypass exhaust conduit and out the bypass outlet in response to selection of a control mode of the marine propulsion device other than a default lever control mode; and wherein the control mode is one in which the control module automatically reduces the throttle position commands from the operator input device by a predetermined factor before sending the reduced throttle position commands to the throttle valve.

2. The system of claim 1, wherein the control module opens the bypass valve in response to an additional determination that a transmission of the marine propulsion device is in reverse gear.

3. The system of claim 1, wherein the control module opens the bypass valve in response to an additional determination that external environmental conditions are acting on the marine vessel in a direction opposite that of a reverse thrust of the marine propulsion device.

4. The system of claim 1, wherein the bypass valve is configured to be incrementally opened and closed.

5. The system of claim 1, wherein the bypass exhaust conduit and the bypass outlet are in fluid communication with an idle relief system of the marine propulsion device.

6. The system of claim 1, wherein the bypass outlet is located remote from the aft end of the gearcase housing.

7. A method for controlling flow of exhaust gas from an internal combustion engine powering a marine propulsion device configured to propel a marine vessel in a body of water, the method being carried out by a control module and comprising:

determining if the marine propulsion device is being operated in a control mode other than a default lever control mode;

determining if a transmission of the marine propulsion device is in reverse gear; and in response to the marine propulsion device being operated in the control mode other than the default lever control mode and the transmission being in reverse gear, opening a bypass valve to direct a bypass flow of the exhaust gas through a bypass exhaust passageway for discharge from a bypass outlet of the marine propulsion device;

wherein the bypass exhaust passageway is configured to receive the bypass flow of the exhaust gas from a primary exhaust passageway when the bypass valve is open, and the primary exhaust passageway is configured to receive a primary flow of the exhaust gas from the internal combustion engine and to discharge the primary flow of the exhaust gas to the body of water via a gearcase housing of the marine propulsion device;

wherein the primary flow of the exhaust gas is discharged from an aft end of the gearcase housing, and the bypass outlet is located remote from the aft end of the gearcase housing;

wherein an operator input device is configured to provide throttle position commands to a throttle valve of the internal combustion engine via the control module; and wherein the control mode is one in which the control module automatically reduces the throttle position commands from the operator input device by a predetermined factor before sending the reduced throttle position commands to the throttle valve.

8. The method of claim 7, further comprising opening the bypass valve in response to an additional determination that external environmental conditions are acting on the marine vessel in a direction opposite that of a reverse thrust of the marine propulsion device.

9. The method of claim 7, further comprising incrementally opening or closing the bypass valve.

10. The method of claim 7, wherein the bypass exhaust passageway and the bypass outlet are in fluid communication with an idle relief system of the marine propulsion device.

* * * * *